United States Patent [19]

Mueller

[11] Patent Number: 4,613,528

[45] Date of Patent: Sep. 23, 1986

[54] APPARATUS FOR APPLYING A PROTECTIVE COATING TO INNER BODY CAVITIES OF VEHICLES

[75] Inventor: William P. Mueller, Elyria, Ohio

[73] Assignee: Nordson Corporation, Amherst, Ohio

[21] Appl. No.: 777,626

[22] Filed: Sep. 19, 1985

[51] Int. Cl.[4] ..... B05D 1/02

[52] U.S. Cl. ..... 427/421; 427/236; 118/668; 118/708; 118/305; 118/306

[58] Field of Search ..... 118/668, 708, 305, 306; 427/421, 236

[56] References Cited

U.S. PATENT DOCUMENTS

| | | | |
|---|---|---|---|
| 3,227,575 | 1/1966 | Ziebart | 117/49 |
| 3,561,398 | 2/1971 | Rose et al. | 118/7 |
| 4,072,127 | 2/1978 | Cernauskas et al. | 118/2 |
| 4,108,382 | 8/1978 | Ryd et al. | 239/271 |
| 4,251,573 | 2/1981 | Holm et al. | 427/236 |
| 4,269,141 | 5/1981 | Kennett | 118/708 |
| 4,270,484 | 6/1981 | Shimatani et al. | 118/305 |
| 4,305,344 | 12/1981 | Baskett | 118/305 |
| 4,420,511 | 12/1983 | Liedberg | 427/236 |
| 4,455,965 | 6/1984 | Jung et al. | 118/622 |
| 4,504,525 | 3/1985 | Bellafiore | 427/230 |

FOREIGN PATENT DOCUMENTS

| | | | |
|---|---|---|---|
| 3004495 | 8/1981 | Fed. Rep. of Germany . | |
| 2827770 | 12/1982 | Fed. Rep. of Germany . | |
| 3334047 | 2/1985 | Fed. Rep. of Germany . | |
| 929237 | 5/1982 | U.S.S.R. | 118/305 |

OTHER PUBLICATIONS

Atlas Copco Annual Report 1984, "Outlook for 1985", p. 45.

*Primary Examiner*—Shrive P. Beck
*Attorney, Agent, or Firm*—Wood, Herron & Evans

[57] ABSTRACT

A method and apparatus of applying a protective coating to the inner cavities of vehicle body components comprises a frame supporting a plurality of spray guns which is adapted to mount in a locked position upon the vehicle panel to be coated. Sensors indicate the presence of the frame in a locked position and send a signal to an electro-pneumatic controller. The controller includes a bank of pneumatic valves which interface with the spray guns and sensors mounted to the frame, and a programmable computer control which activates the pneumatic valves. Once the frame is positioned and sensed in a locked position, the controller activates linear actuators which move the spray guns to a predetermined, spraying position with respect to the vehicle body component. Sensors indicate the presence of the spray guns in such spraying position, and send a signal to the controller. The controller then initiates the spraying operation in which a protective coating is discharged from the spray guns while they are rotated relative to the vehicle body component. The extent of angular rotation of the spray guns, duration of the spraying operation and number of spray guns activated at one time are variable according to the body component to be coated so as to obtain a uniform, uninterrupted coating onto all body components.

17 Claims, 5 Drawing Figures

APPARATUS FOR APPLYING A PROTECTIVE COATING TO INNER BODY CAVITIES OF VEHICLES

BACKGROUND OF THE INVENTION

Figure 1:
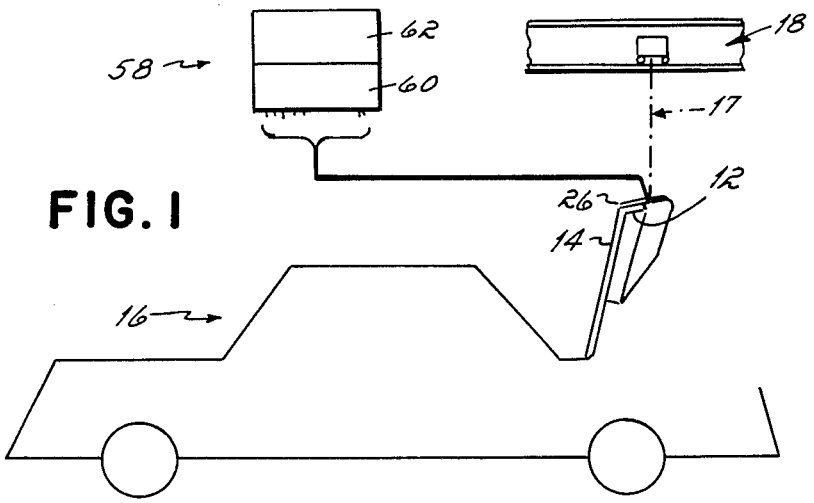

This invention relates to the application of protective coatings to vehicles, and, more particularly, to a method and apparatus for applying wax or similar protective coatings to the inner cavities of rear deck lids and other body components of vehicles.

It is common practice among vehicle manufacturers to apply wax or other protective coatings to the inner cavities of vehicle body components such as doors, rear deck and hatchback lids, hoods, fender panels and underbodies. The goal is to provide a uniform, uninterrupted coating along the hem flange areas of such components and other areas where water and corrosive materials are most likely to collect.

In most vehicle assembly lines, protective coatings are currently applied to body components manually by an operator using a hand held spray gun. The major problem with this practice is that the coating material is often applied unevenly, and, in some instances, voids are created where no coating is applied to the body component. This is particularly true in coating doors or other body components of irregular shape which include a number of crevices along their inner cavities.

One solution to the problems associated with manual coating operations has been proposed, for example, in German Patent No. 2,827,770. In the German patent, an automatic coating system is proposed in which the position and movement of at least one spray gun is mechanically controlled, and the volume of protective coating supplied to the spray guns for discharge onto the body component is variable depending on the configuration of the body component to be coated.

Mechanical spray coating systems of the general type described above reduce the problem of uneven or interrupted coating of vehicle components associated with current manual coating techniques. However, no provision is made in the German patent, or other systems known to applicant, to assure proper positioning of the spray guns relative to the body component to be coated, or proper spray patterns where multiple spray guns are employed. Specifically, such systems do not provide for an indication of the proper positioning of the apparatus and/or the spray guns prior to the initiation of a coating operation. Unless the spray guns are properly oriented with respect to the vehicle body component to be coated, the protective coating may not be applied at the desired locations or with the desired uniformity.

SUMMARY OF THE INVENTION

It is therefore among the objects of this invention to provide a method and apparatus for applying a protective coating to the inner cavities of vehicle body components which is movable along a vehicle assembly line, which is adapted to mount upon and lock in position against a vehicle body component to be coated, which is completely automatic in operation once locked in place, which provides a uniform, uninterrupted coating on the body component to be coated and which prevents the release of coating material onto the body component unless properly positioned relative to the body component.

These objectives are accomplished in a method and apparatus according to this invention in which an even, uninterrupted coating of a anti-corrosion material such as wax is applied to a body component of a vehicle. The apparatus includes a frame, supporting a plurality of spray guns, which is movable along a vehicle assembly line and adapted to mount in a locked position directly upon a body component to be coated. An electro-pneumatic controller is operatively connected to actuators which mount the spray guns upon the frame and function to linearly position and rotate the spray guns. Sensors mounted upon the frame send signals to the controller indicating the presence of the frame in its locked position, and the movement of the spray guns to a predetermined, spraying position. The controller is operable, upon receipt of such signals, to control the rotation of the spray guns and discharge of wax therefrom.

The method of coating vehicle body components employing the apparatus of this invention comprises the steps of mounting the frame upon the vehicle body component, locking the frame in place, sensing the presence of the frame in the locked position, moving the spray guns to a predetermined, spraying position, sensing the presence of the spray guns at such spraying position and discharging wax through the spray guns while rotating them relative to the vehicle body component.

More specifically, in a presently preferred embodiment, the apparatus of this invention comprises a frame having a perimeter support bar conforming generally to the shape of the body component to be coated, and a number of vertical support bars and cross braces mounted on the perimeter support bar. The vertical support bars and cross braces mount four spray guns which are connected in series by insulated fluid lines carrying heated wax which is continuously circulated therethrough. The operation of the spray guns in discharging wax onto the vehicle body component, and all other operations of the system described in detail below, are controlled by an electro-pneumatic controller. The controller includes a bank of pneumatic valves, connected to a plurality of pneumatic lines as described below, which valves are activated by electrical signals from a programmable, computer control. The bank of pneumatic valves functions to interface the electrical command signals from the programmable computer control with the pneumatic lines connected to the spray guns and other elements of the apparatus. This avoids the use of electrically operated valves in the area of the spray guns so as to reduce the explosion hazard.

The frame mounting and locking operation begins once a hook bracket mounted to the perimeter support bar is placed over the body component to be coated. An operator then grasps a pair of handles mounted to the perimeter support bar and moves the entire frame against the vehicle body component. When the frame is in this position, the operator depresses a pair of palm buttons mounted to the handles which send a signal to the controller. The controller, in turn, activates a pneumatic locking cylinder which forces a locking pin into an aperture formed in the body component to lock the frame to the body component. A sensor, in response to the movement of the frame against the body component and the operation of the locking cylinder, sends a pneumatic signal to the controller indicating that the locking operation has been completed.

In a presently preferred embodiment of this invention, the controller is then operable to begin a position-continuously therethrough. The wax is introduced to the system through inlet line 48, which connects to spray gun D and then flows through the spray guns C, B, A through connector lines 50, 52, 54, respectively. The wax is continually recirculated through a pump (not shown) and back through outlet line 56 connected to spray gun A. One or more heaters, such as a Nordson NH4 heater, is incorporated into the fluid circuit to keep the wax at the desired temperature. Preferably, the ends of inlet and outlet wax lines 48, 56 are coupled to quick disconnect connectors 57, 59, respectively.

The discharge of the wax through the spray guns A-D, the positioning of each spray gun A-D relative to the rear deck lid 14 and other operational aspects of the apparatus 10 described in detail below are controlled by an electro-pneumatic controller 58 shown schematically in the drawings. The controller 58 comprises a panel or bank 60 of pneumatic valves operatively connected by solenoid valves or other means (not shown) to a computer control 62 which sends command signals to the pneumatic valve bank 60 to control their operation. The computer control 62 is programmable so that the operation of the apparatus 10 can be varied to accommodate various types of vehicle body components to be coated, as described below. Preferably, the controller 58 is disposed remotely from the spray guns A-D so that its electrical signals to the pneumatic valve bank 60 do not create an explosion hazard in apparatus 10, which is otherwise protected from such a hazard by the exclusive use of pneumatic elements in the spraying area surrounding the spray guns A-D.

The pneumatic valve bank 60 interfaces with twenty-four pneumatic lines through three couplers 64, 66, 68, each having quick disconnect connections illustrated schematically in the drawings. As discussed below, coupler 64 mounts 10 pneumatic lines, and couplers 66, 68 mount 8 and 6 pneumatic lines, respectively.

The apparatus 10 of this invention is operable to apply a uniform, uninterrupted wax coating upon the tail end portion 12 of the rear deck lid 14. This is accomplished in a sequential operation in which the frame 20 is first mounted upon the rear deck lid 14 and then locked in a fixed position thereto. A signal is sent to the controller 58 when the presence of frame 20 in the locked position is sensed. The controller is then operable to effect movement of the spray guns A-D to predetermined, spraying positions. A signal indicating the presence of the spray guns A-D at such spraying positions is then sent to the controller 58. Upon receipt of such signal, the controller 58 controls the discharge of wax through at least two of the spray guns A-D while simultaneously activating the corresponding rotary actuators 36*a–d* for rotating the spray guns A-D relative to the rear deck lid 14.

Each step in the coating operation, and the manner in which the apparatus 10 accomplishes such steps, is described in detail below in the sequence in which they are performed.

Figure 3:
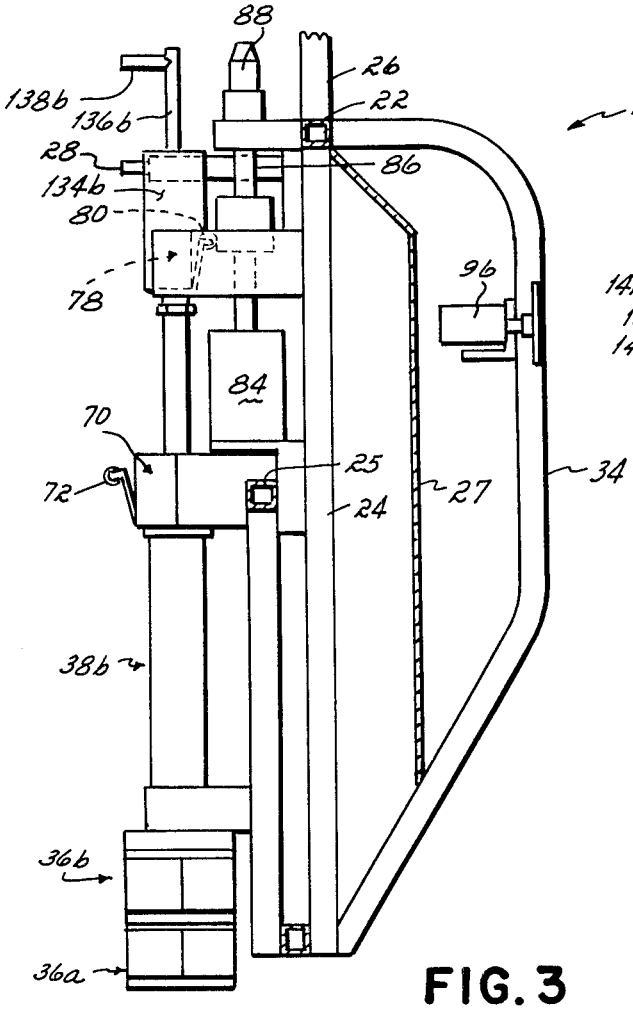
Figure 5:
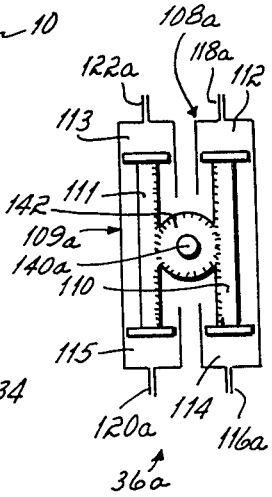
Figure 2:
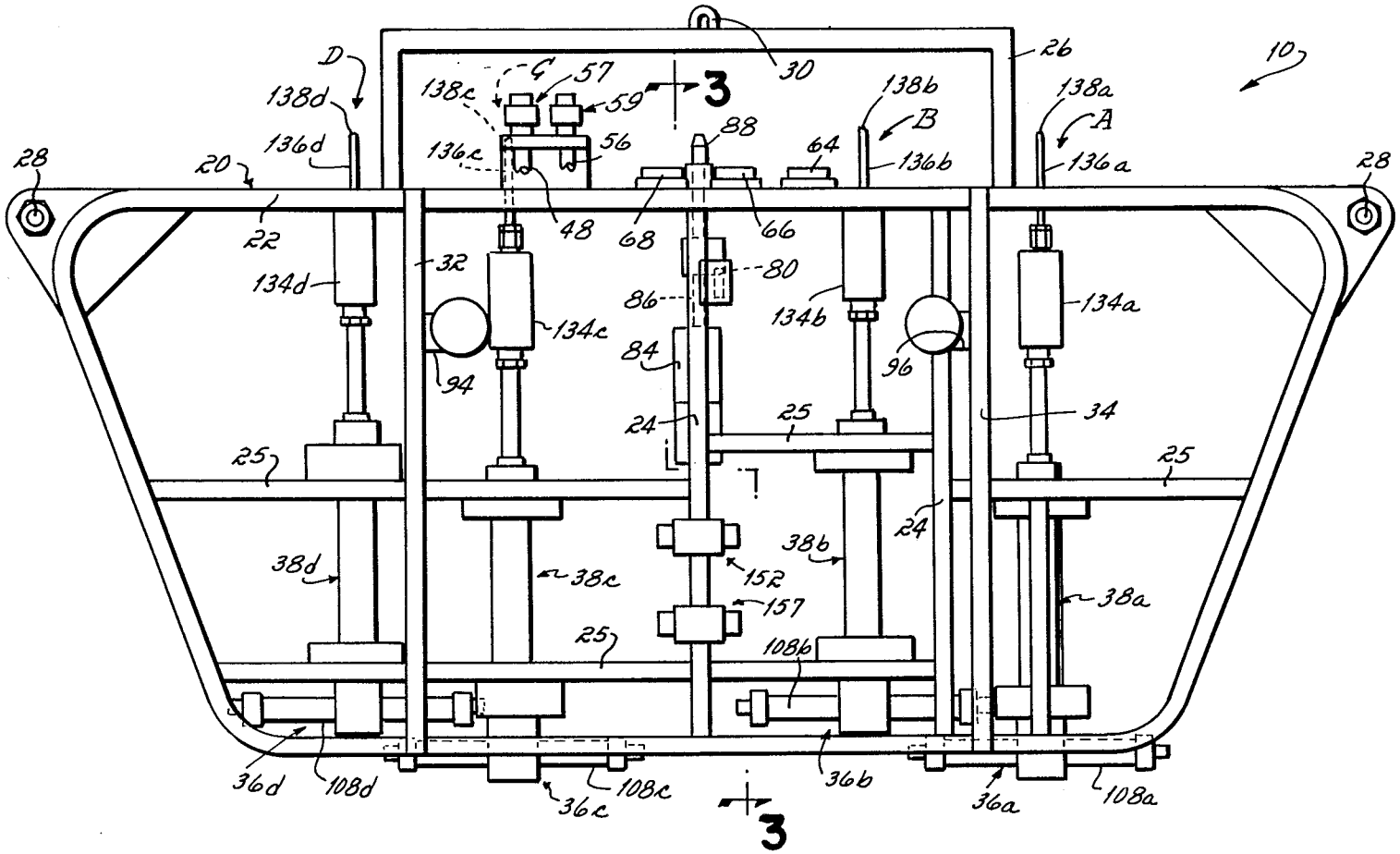
Figure 4:
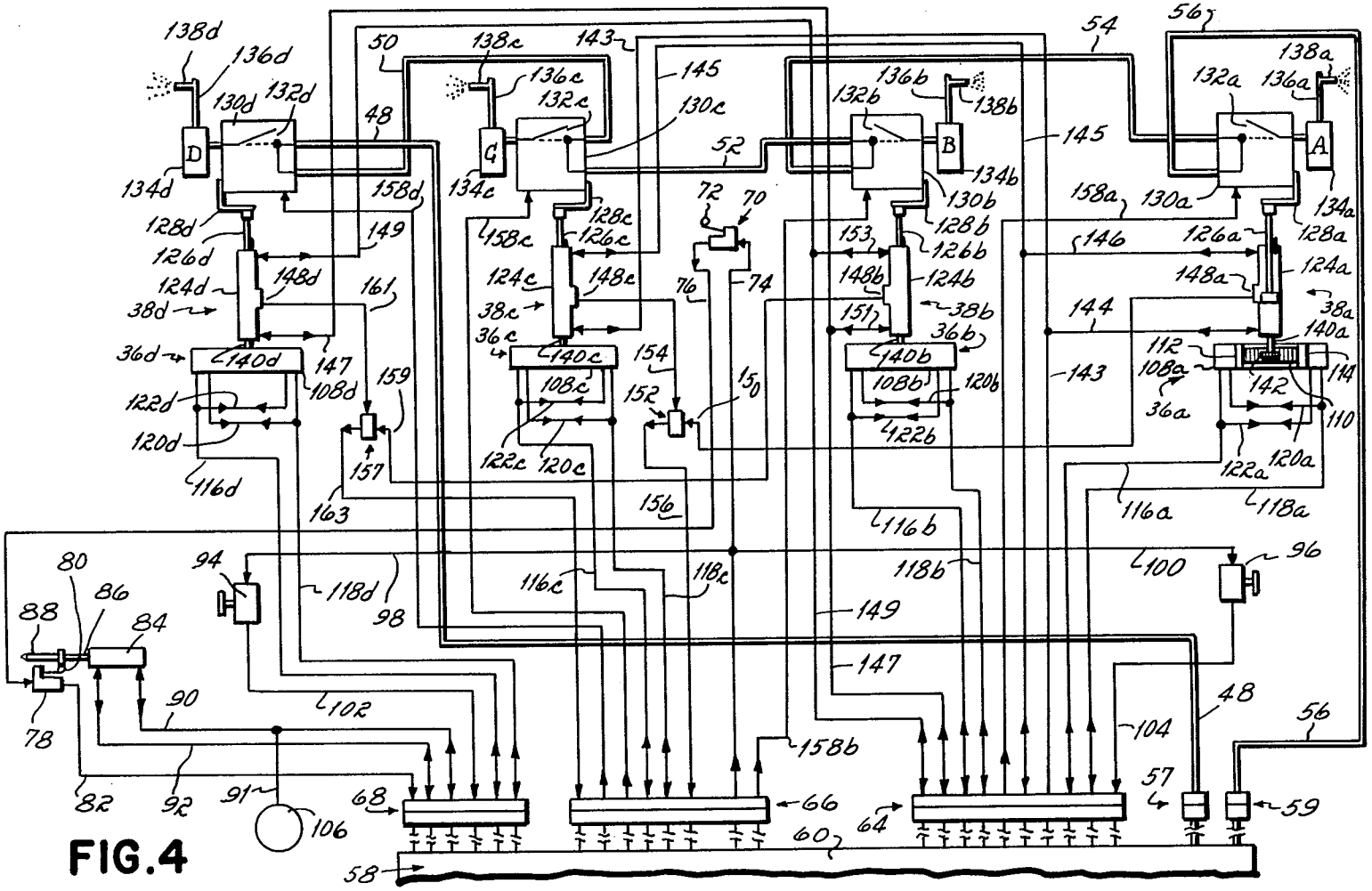

Referring now to FIG. 3, the mounting and locking operation for securing the frame 20 to the rear deck lid 14 will be considered first. Initially, the frame 20 is positioned in alignment with the rear deck lid 14 by the track and trolley 18 and lowered by cable and tool balancer 17 so that the hook bracket 26 engages the rear deck lid 14. An operator then grasps the handles 32, 34 and moves the frame 20 against the rear deck lid 14 so that the locator pins 28 are in engagement with the apertures therein.

A lever valve 70 having a movable roller 72 is connected to one of the vertical support bars 24. The lever valve 70 is provided with pressurized air through an inlet line 74 connected to coupler 66, and has an exhaust line 76 which connects to a second lever valve 78 having a roller 80. The second lever valve 78 exhausts to the controller 58 through a line 82 which mounts to the coupler 68. Each of the lever valves 70, 78 are commercially available from Aro Corporation, Bryan, Ohio, Part No. 202-C.

A locking cylinder 84 having a piston 86 connected to a pin 88 is mounted to the frame 20 so that its piston 86 is positioned to engage the roller 80 of second lever valve 78. A suitable locking cylinder 84 is available from Fabco-Air, Gainesville, Florida, Part No. I-121-X-K-MR. The locking cylinder 84 is operatively connected to the controller 58 through lines 90, 92 which mount to coupler 68. The lines 90, 92 each function as pressure and exhaust lines, so that the piston 86 of the locking cylinder 84 may be either extended or retracted, depending on which line 90, 92 is pressurized, to impart lateral movement to the pin 88 connected thereto.

Locking of the frame 20 to the rear deck lid 14 is accomplished as follows. When the frame 20 is placed against the rear deck lid 14 as described above, the roller 72 of first lever valve 70 is depressed and functions to open first lever valve 70. The air from inlet line 74 then flows from the first lever valve 70, through the exhaust line 76 to the second lever valve 78.

At this point, the operator depresses a pair of palm buttons 94, 96, commercially available from Aro Corporation, Part No. 460-3, which are mounted to the frame handles 32, 34, respectively. The palm buttons 94, 96 are supplied with pressurized air through connector lines 98, 100, respectively, which connect to the supply line 74 of first lever valve 70. When the palm buttons 94, 96 are depressed, air is released through their exhaust lines 102, 104, respectively, which lead to the controller 58 through couplers 68, 64. Upon receipt of the pneumatic signals from the palm buttons 94, 96, the controller 58 activates the locking cylinder 84 by pressurizing line 90. This moves the piston 86 outwardly from the cylinder housing so that the pin 88 enters an aperture (not shown) formed in the rear deck lid 14 to securely mount the frame 20 thereto. The pin 88 is shown in its extended position in FIG. 3.

In accordance with an important aspect of this invention, the apparatus 10 is provided with a Csensor to sense the presence of the frame 20 in its locked position. This assures that the frame 20 is properly positioned relative to the rear deck lid 14 before the spraying operation begins. The presence of frame 20 in a locked position is sensed as follows.

As the piston 86 of locking cylinder 84 is extended, it engages roller 80 which opens the second lever valve 78. See FIG. 3. The air supplied to second lever valve 78 from the first lever valve 70 is then exhausted through line 82 to the controller 58. This provides the controller 58 with an indication both that the roller 72 of first lever valve 70 has contacted the rear deck lid 14, and that the piston 86 of locking cylinder 84 has been extended to insert the pin 88 within the rear deck lid aperture. Therefore, the frame 20 has been locked in place upon the rear deck lid 14, and the controller 58 has been provided with a signal indicating the presence of the frame 20 in such locked position. A pneumatically activated signal indicator 106, commercially available from Aro Corporation, Part No. 59107, is conmolecular weight of about 400 to 6000: a diisocyanate or mixtures of diisocyanates; and the above-mentioned amide as a chain lengthening agent, optionally with further chain lengthening agents, preferably low molecular weight diols and in particular butane diol-1,4.

The amide may be produced in a straightforward manner by reacting 2,2-bis(hydroxymethyl)propionic acid methyl ester and ammonia. The melting point of the substance which was used for the experiments which are described hereinafter is from 174° to 175° C. and is thus higher than described in DE-A No. 2,621,284, thereby indicating a purer preparation.

According to the present invention it is possible to use isophorone diisocyanate, hexamethylene diisocyanate and trimethyl-hexamethylene diisocyanate, optionally as a mixture of the isomers or homologues thereof or as a mixture of various diisocyanates.

Polyesters, polyester amides, polyethers, polyacetals and polycarbonates, which are conventionally used in the production of polyurethanes, are suitable as relatively high molecular weight polyhydroxy compounds. Compounds having two hydroxyl groups per molecule are preferably used, especially those which have an average molecular weight ranging from about 400 to 6000, preferably from about 800 to 3000.

The polyesters containing hydroxyl groups which are

In the embodiment of apparatus 10 for coating the tail end portion 12 of rear deck lid 14, four spray guns A-D are required to completely cover the area to be coated. In order to achieve a uniform, uninterrupted coating on the rear deck lid 14, the spray patterns from the spray guns A-D must not interfere with one another. Accordingly, the controller 58 is programmed to operate the spray guns A-D sequentially wherein spray guns A and C are operated at the same time, and thereafter spray guns B and D are operated. The operation of spray guns A, C in discharging wax onto the rear deck lid 14 is described herein, it being understood that spray guns B and D operate in the identical manner.

In controlling the discharge of heated wax from the spray guns A and C, the controller 58 performs two operations simultaneously. Through pressure lines 158*a, c,* the controller 58 provides a pneumatic signal which opens the internal valves 132*a, c* of manifold blocks 130*a, c* so that wax is released to the spray guns A and C, respectively, for discharge onto the rear deck lid 14. Simultaneously, the inlet/exhaust lines 116*a,* 118*a,* or 116*c,* 118*c,* are pressurized to rotate the spray guns A and C in the manner described above. The spray guns A, C therefore discharge wax, and are simultaneously rotated, in order to apply an even, uninterrupted coating to the tail end portion 12 of rear deck lid 14.

It should be understood that the extent of rotation of spray guns A, C, the volume of flow of wax therethrough and the periods at which wax is discharged throughout the angular travel of spray guns A, C can be easily varied by changing the program of the computer control 62 segment of controller 58. For example, the air supply to rotary actuators 36*a, c* could be timed, as desired, to effect a small or large angular rotation of spray guns A, C. In addition, the operation of pressure lines 158*a, c* could be timed to open and close the internal valves 132*a, c* of manifold blocks 130*a, c* to effect a release of wax through spray guns A, C intermittently, or continuously, throughout their angular travel. It is contemplated that such independent control of the rotational and linear movement of the spray guns A-D, and the duration of the discharge of wax from each spray gun A-D, would permit the proper coating of interior body components of various shapes and sizes.

Spray guns B and D operate in the identical manner as spray guns A and C, and are activated by controller 58 after spray guns A, C have completed coating their areas of the rear deck lid 14.

It is contemplated that in coating other body components of a vehicle, different numbers of spray nozzles may be utilized and it may not be necessary for the spray nozzles to be operated sequentially in order to avoid interference between their spraying patterns. In addition, it is contemplated that the position of spray guns A-D need not be adjustable in all applications but could remain fixed. This would be accomplished by either eliminating the linear actuators 36*a–d,* or altering the program of computer control 62 to bypass the spray gun positioning step described above for the embodiment of this invention used to coat a rear deck lid 14. The configuration and operation of the apparatus 10 illustrated in the drawings for coating a rear deck lid 14 is therefore intended to be illustrative of the concept of this invention and should not be considered as a limitation thereto.

Once the second group of spray guns B, D has completed operation, the controller 58 supplies air to the locking cylinder 84 in the reverse direction to retract pin 88 from the aperture in the rear deck lid 14. When the piston 86 of the locking cylinder 84 is retracted, it disengages the roller 80 of second lever valve 78 in preparation for another coating operation. At the same time, the signal indicator 106 is deactivated to advise the operator that the coating cycle has been completed. The operator then grasps the frame handles 32, 34 and removes the frame 20 from the rear deck lid 14 in preparation for another coating operation.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments following within the scope of the appended claims.

What is claimed is:

1. A method of applying a protective coating to the inner cavities of a panel of a vehicle, comprising the steps of:

moving a frame having at least one spray gun into a position locked to the panel of the vehicle;

sending a signal to a controller in response to sensing the presence of said frame in said locked position;

spraying protective coating from said spray guns onto the panel of the vehicle in response to said controller receiving said signal; and simultaneously rotating said spray guns to obtain a uniform, uninterrupted protective coating on at least a portion of the panel of the vehicle.

2. The method of claim 1 in which said step of spraying protective coating from said spray guns onto the panel of the vehicle further comprises:

activating one set of spray guns for spraying protective coating onto a portion of the panel of the vehicle;

deactivating said one set of spray guns;

activating a second set of spray guns for spraying protective coating onto another portion of the panel of the vehicle.

3. A method of applying a protective coating to the inner cavities of a panel of a vehicle, comprising the steps of:

moving a frame having a plurality of spray guns into a position locked to the panel of the vehicle;

sensing the presence of said fixture in said locked position;

sending a first signal to a controller in response to sensing said frame in said locked position;

moving said spray guns to spraying positions with respect to the panel of the vehicle;

sensing the presence of said spray guns in said spraying positions;

sending a second signal to said controller upon sensing said spray guns in said spraying positions;

spraying protective coating from said spray nozzles onto the panel of the vehicle in response to said controller receiving said first and second signals;

simultaneously rotating said spray nozzles to obtain a uniform, uninterrupted protective coating on at least a portion of the panel of the vehicle.

14. The apparatus of claim 11 further including a plurality of manifold blocks each having an internal valve, each of said manifold blocks mounting one of said spray guns to said frame, said manifold blocks being serially interconnected by fluid lines carrying protective coating for the continuous circulation of protective coating therethrough.

15. The apparatus of claim 14 in which each of said manifold blocks is operatively connected to said controller, said controller being operable to close said internal valves in said manifold blocks to permit the discharge of wax through said spray guns connected thereto.

16. The apparatus of claim 15 in which said controller includes a computer control operable to selectively close said internal valves of said manifold blocks so as to permit the discharge of wax through selected spray guns in a timed sequence.

17. An apparatus for applying a protective coating to the inner cavities of a panel of a vehicle comprising:

means for moving a frame having a plurality of spray guns into a locked position on the panel of the vehicle;

means for sensing the presence of said fixture in said locked position;

means for sending a first signal to a controller in response to sensing said frame in said locked position;

means for moving said spray guns to spraying positions with respect to the panel of the vehicle;

means for sensing the presence of said spray guns in said spraying positions;

means for sending a second signal to said controller upon sensing said spray guns in said spraying positions;

means for spraying protective coating from said spray nozzles onto the panel of the vehicle in response to said controller receiving said first and second signals;

means for simultaneously rotating said spray nozzles to obtain a uniform, uninterrupted protective coating on at least a portion of the panel of the vehicle.

* * * * *